United States Patent [19]

Scott

[11] 4,126,158

[45] Nov. 21, 1978

[54] SLIDE FASTENER STRINGER AND METHOD AND APPARATUS FOR MANUFACTURE

[75] Inventor: George W. Scott, Conneaut Lake, Pa.

[73] Assignee: Textron Inc., Providence, R.I.

[21] Appl. No.: 739,091

[22] Filed: Nov. 5, 1976

[51] Int. Cl.[2] ..... A44B 19/12

[52] U.S. Cl. ..... 139/384 B; 139/11; 24/205.13 C; 24/205.16 C

[58] Field of Search ..... 139/11, 384 B; 24/205.13 C, 205.16 C, 205.1 C

[56] References Cited

U.S. PATENT DOCUMENTS

| | | | |
|---|---|---|---|
| 3,266,114 | 8/1966 | Gerlach et al. | 139/384 B |
| 3,765,457 | 10/1973 | Glindmeyer et al. | 139/384 B |
| 3,822,444 | 7/1974 | Johns | 24/205.16 C |
| 3,901,291 | 8/1975 | Nogai | 139/384 B |
| 3,908,242 | 9/1975 | Reynolds | 24/205.16 C |

FOREIGN PATENT DOCUMENTS

| | | | |
|---|---|---|---|
| 1,253,944 | 11/1967 | Fed. Rep. of Germany | 24/205.16 C |

*Primary Examiner*—Henry S. Jaudon
*Attorney, Agent, or Firm*—O'Brien and Marks

[57] ABSTRACT

In a woven slide fastener stringer, a meander coupling element has a V-shaped cross-sectional configuration with a cord inserted between legs thereof to maintain the V-configuration. Additionally, gaps are formed in the weaving of a slide fastener stringer by intermittently cutting a continuous coupling element and momentarily discontinuing the feeding of the continuous coupling element.

18 Claims, 12 Drawing Figures

FIG. 1
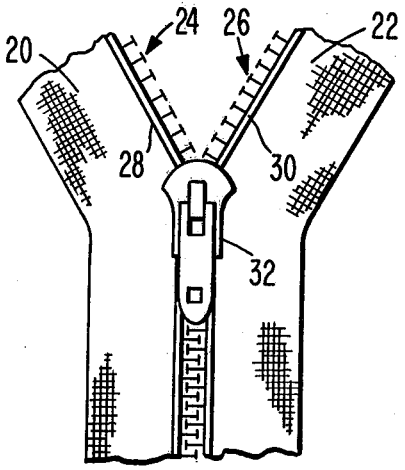
FIG. 2
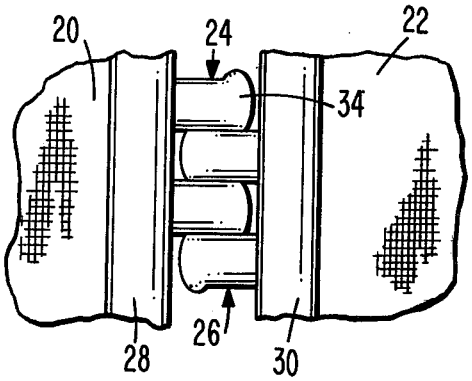
FIG. 3
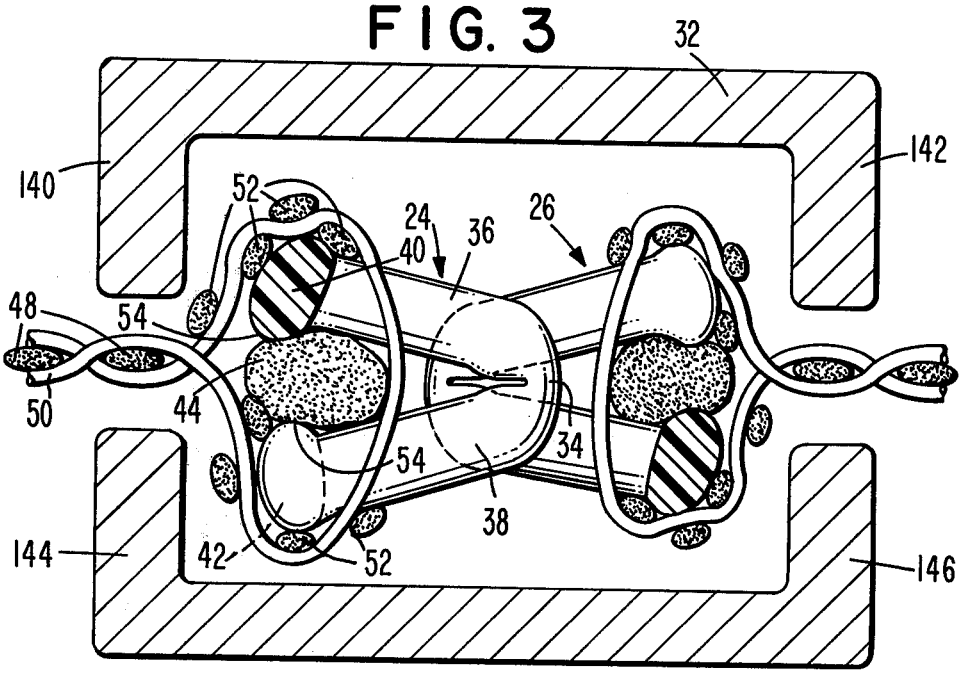
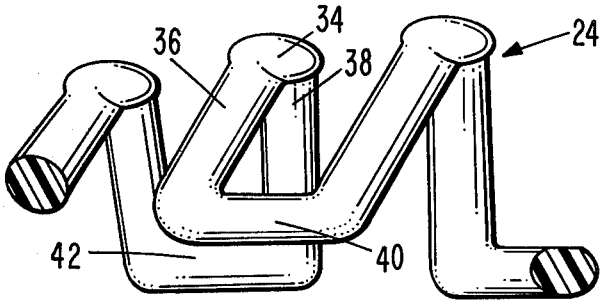
FIG. 4

SLIDE FASTENER STRINGER AND METHOD AND APPARATUS FOR MANUFACTURE

BACKGROUND OF THE INVENTION

1. Field of the Invention

The invention relates to woven slide fasteners and to methods and apparatus for weaving slide fastener chains.

2. Description of the Prior Art

The prior art contains many woven slide fastener chains as well as methods and apparatus for the manufacture thereof; such a weaving apparatus being disclosed in U.S. Pat. No. 3,123,103. In the prior art a continuous coupling element is fed in synchronism with warp threads to a weaving station where a weft thread is woven with the warp threads and passed over interconnecting portions of the continuous coupling element to form a stringer of a slide fastener chain. Although stringers with various types of continuous coupling elements, such as spiral coupling elements, meander coupling elements, continuous trains of molded coupling elements, etc., have been woven to the edges of tapes, most woven slide fasteners are made with spiral coupling elements rather than with meander or other types of coupling elements in spite of the fact that the crosswise strength of slide fasteners with spiral coupling elements, which are formed from a filament of oblate cross-section twisted in a manner to produce interlocking head portions, is less than the crosswise strength of similar size meander filament type interlocking coupling elements which have enlarged interlocking head portions formed by plastic deformation of the filament. Sometimes longitudinal cords have been included within the coils of spiral coupling elements in the woven stringers. The commercially acceptable slide fasteners employing meander coupling elements are generally made by sewing the leg portions of the meander coupling elements to the tape rather than weaving the meander coupling element with the tape; prior art woven slide fasteners with meander coupling elements generally are deficient in that the meander coupling elements were not sufficiently secured to maintain adequate stability and positioning of the meander coupling elements.

SUMMARY OF THE INVENTION

The invention is summarized in a stringer for a slide fastener including an elongated coupling element formed from a meandering continuous filament and having successive sections each including a head portion formed by flattening the filament, a pair of leg portions extending from opposite sides of the head portion in diverging directions to form a V-shaped configuration, and interconnecting portions joining the pair of leg portions to the respective opposite adjoining sections, said interconnecting portions alternately extending in a pair of diverging planes which intersect at the head portions and extend along the leg portions from the respective opposite sides of the head portions; a cord extending between the leg portions of each pair of leg portions and between the alternating interconnecting portions to maintain the pairs of leg portions apart in the V-shaped configuration; and a woven tape having warp threads parallel to the coupling element and having an interwoven weft thread which passes around the cord and the alternating leg portions to secure the coupling element to the tape.

An object of the invention is to construct a woven slide fastener employing meander coupling elements for improved crosswise strength.

Another object of the invention is to produce a slide fastener employing a continuous meander coupling element which offers the low cost advantage of a woven slide fastener.

It is also an object of the invention to produce a woven slide fastener with a meander type coupling element with substantially improved securement and support for the meander coupling element.

One feature of the invention is that the leg portions of the meander coupling element are made substantially shorter and are then held spaced in a V configuration by a cord therebetween in order to provide a firm union with a woven tape.

Another feature of the invention is that a cord inserted between the leg portions of a meander coupling element is secured thereto by a wrapped thread prior to weaving the coupling element with a tape.

Another aspect of the invention is that a continuous coupling element is cut and the feeding thereof is discontinued for a duration during the weaving operation of a slide fastener stringer to form a gap in the stringer.

Other objects, advantages and features of the invention will be apparent from the description of the preferred embodiment when taken in conjunction with the accompanying drawings.

BRIEF DESCRIPTION OF THE DRAWINGS

FIG. 1 is a plan view of a slide fastener constructed in accordance with the invention.

FIG. 2 is an enlarged plan view of a broken-away portion of the fastener of FIG. 1.

FIG. 3 is a cross-sectional view of a broken-away portion of the slide fastener of FIG. 1.

FIG. 4 is a perspective view of a continuous meander coupling element employed in the fastener of FIG. 1.

DESCRIPTION OF THE PREFERRED EMBODIMENTS

Figure 5:
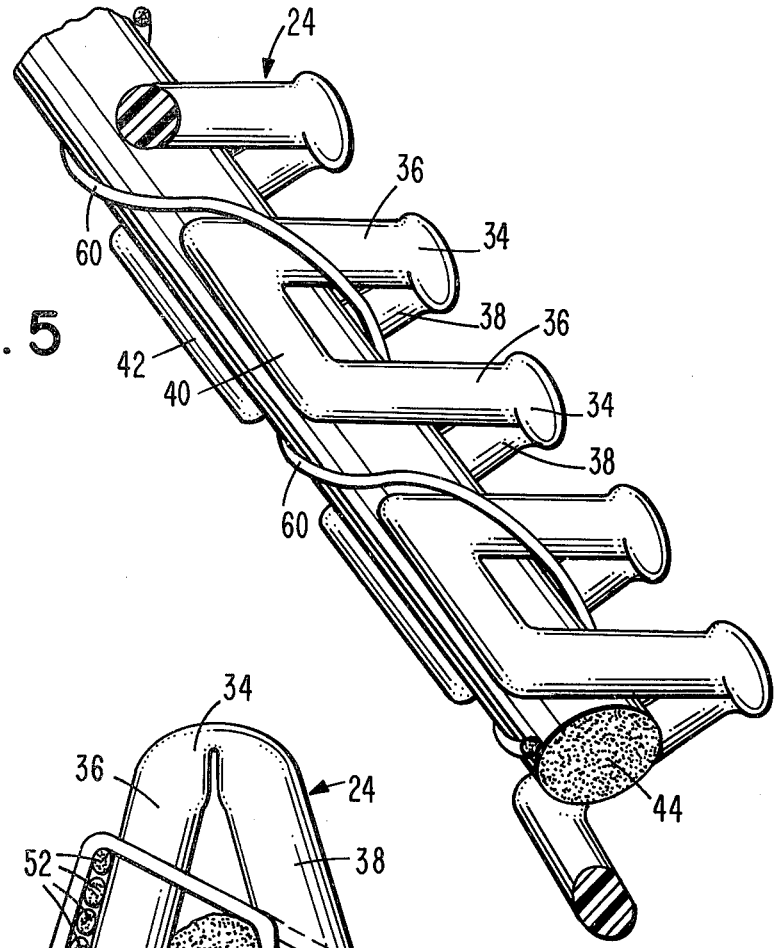
FIG. 5 is a perspective view similar to FIG. 4 but during a later step in the process of manufacture.

A slide fastener, shown in FIGS. 1 and 2, manufactured in accordance with the invention includes a chain formed by a pair of carrier tapes 20 and 22 which have respective continuous coupling elements indicated generally at 24 and 26 secured to inner packages or beaded edges 28 and 30 of the respective tapes 20 and 22. A slider 32 is slidably mounted over the beads 28 and 30 and the coupling elements 24 and 26 for opening and closing the slide fastener. The tape 20 and the continuous coupling element 24 form a left stringer while the tape 22 and the continuous coupling element 26 form a right stringer.

As shown in FIGS. 3 and 4, the coupling element 24 in the left stringer is formed from a continuous filament, such as a monofilament of synthetic polymer, into a meander having successive sections each including a head portion 34, a pair of leg portions 36 and 38 extending from opposite sides of the head portion 34, and interconnecting portions 40 and 42 joining the respective leg portions 36 and 38 with the respective adjoining sections of the coupling element. The filament forming the coupling element 24 is substantially circular in cross-section. The head portions 34 are formed by flattening the cross-section of the monofilament to form substantial protrusions or enlargements along the axis or longitudinal direction of the coupling element 24. The leg portions 36 and 38 are substantially shorter than the leg portions of conventional meander coupling elements which are sewn to a tape. The leg portions 36 and 38 extend in diverging directions from the head portion 34 to lie in diverging planes which intersect along the head portion 34 or to form a V-shaped configuration. The interconnecting or heel portions 40 and 42 also lie in the same planes as the respective leg portions 36 and 38, i.e., the interconnecting or heel portions 40 and 42 alternate in upper and lower planes as illustrated in FIG. 3. The cross section of the cord 44 and the legs 36 and 38 form a triangular configuration. The interconnecting portions 40 and 42 are flattened somewhat during the formation of the coupling elements 24 and 26 in a dimension substantially perpendicular to the respective leg portions 36 and 38.

A cord 44 is inserted between the leg portions 36 and 38 and between the interconnecting portions 40 and 42. The woven tape 20 has a planar portion formed by a plurality of warp threads 48 and a weft thread 50 which is interwoven with the warp threads 48. The weft thread 50 extends completely around and encloses the interconnecting portions 40 and 42 together with the cord 44 to secure the coupling element 24 to the tape 20. A plurality of package or bead warp threads 52 are also interwoven with the weft thread 50 and are positioned around the interconnecting portions 40 and 42 to form the bead 28 of the tape 20. It is noted that the flattening of the interconnecting or heel portions 40 and 42 produces ridges 54 which tend to hold the cord 44 within the coupling element 24 between the legs 36 and 38.

The right stringer is substantially identical to the left stringer.

The stringers for the slide fastener chain are formed on a slide fastener chain weaving apparatus such as that disclosed in U.S. Pat. No. 3,123,103. The cord 44 is introduced between the legs 36 and 38 of the meander coupling elements prior to weaving by guide rolls, fingers, or the like. Also prior to weaving, the cords can be secured to the coupling elements by sewing or as shown in FIG. 5 by wrapping a thread 60 around the cord 44 and the filament of the coupling element 24. In some sizes of coupling elements, it is not necessary to secure the cord 44 prior to weaving as illustrated in FIG. 5; the cord 44 can be inserted via weaving fingers at the weaving area and is secured during the weaving.

In instances where the cord 44 is secured as shown in FIG. 5 the thread 60 preferably passes over a single leg portion of alternate sections and the cord 44 to secure them together. The assembled cord and coupling element are fed into the tubular weaving finger of the weaving apparatus.

Figure 6:
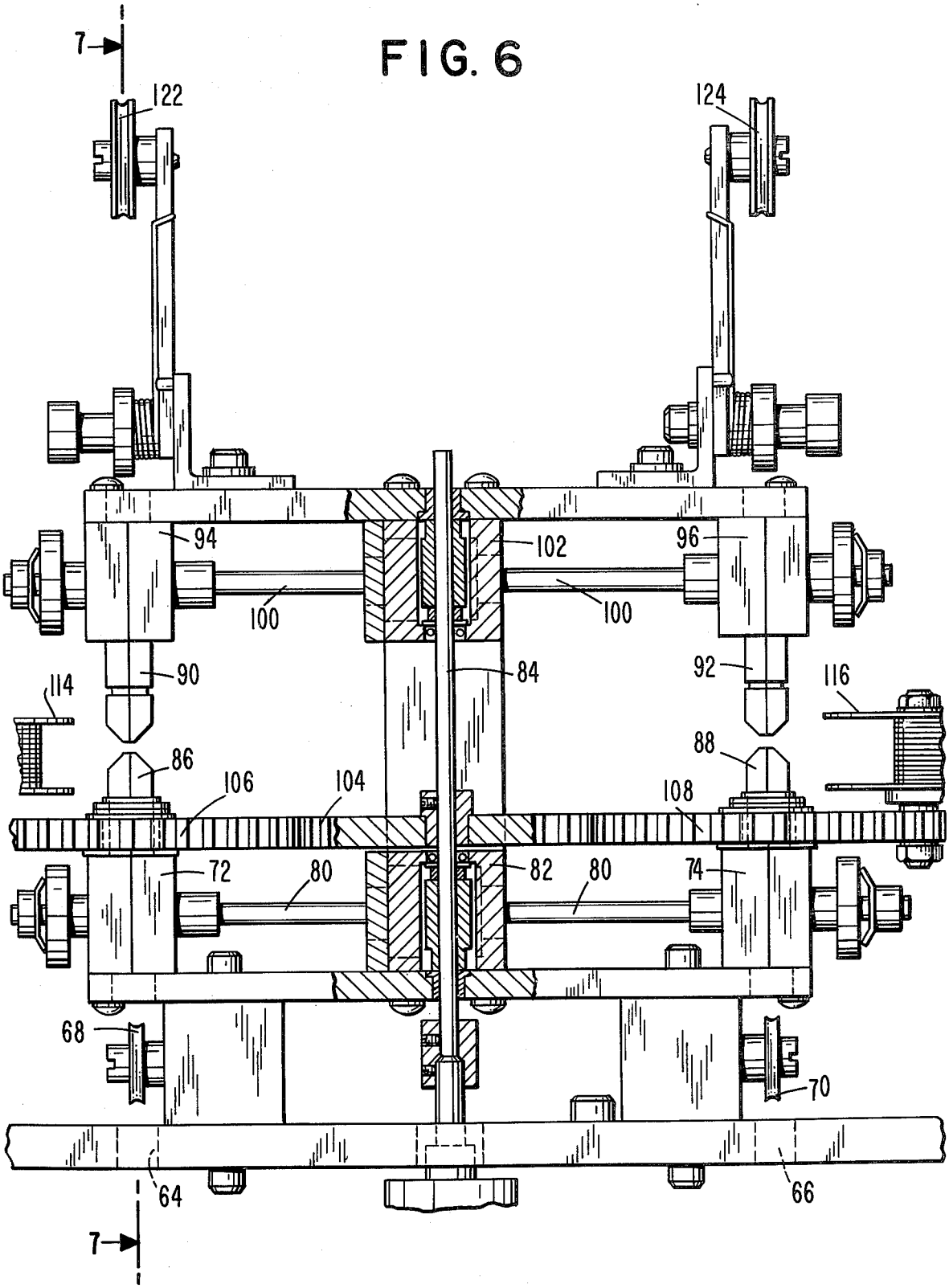
FIG. 6 is a plan view, partially in cross section, of an apparatus for assemblying a cord between leg portions of a meander coupling element in the manufacture of the slide fastener chain of FIG. 1.
Figure 7:
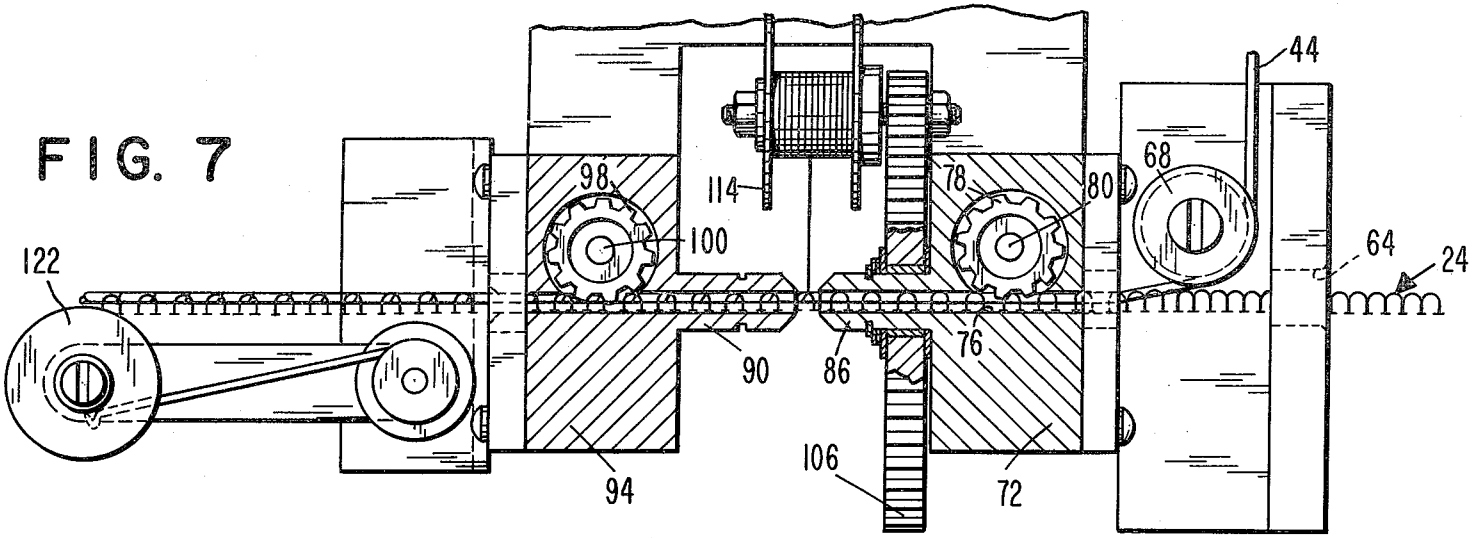
FIG. 7 is a side cross-sectional view of the apparatus of FIG. 6.

As shown in FIGS. 6 and 7, an apparatus for inserting cords 44 within the coupling elements 24 and 26 and wrapping threads 60 around the cords and the filaments of the coupling elements includes first passageways 64 and 66 formed in the frame of the apparatus for receiving the respective coupling elements with a predetermined orientation. Pulleys 68 and 70 are mounted on the frame so as to guide the cords and insert the cords between the legs of the coupling elements. Feeding mechanisms 72 and 74 mounted downstream from the pulleys 68 and 70 have passageways 76 for guiding the assembled cords and coupling elements into meshing engagement with cog wheels 78 mounted on a shaft 80 which is rotated by a worm and gear arrangement 82 driven by a drive shaft 84. Tubular guides 86 and 88 extend from the outlets of the respective feeding mechanisms 72 and 74 in alignment with oppositely extending tubular guides 90 and 92 from inlets of respective feeding mechanisms 94 and 96 which have cog wheels 98 for meshing with the sections of the coupling elements. The cog wheels 98 are mounted on a shaft 100 rotated by a worm and gear assembly 102 driven by the drive shaft 84. A gear wheel 104 is fixed on the shaft 84 and meshes with gear wheels 106 and 108 rotatable mounted on the respective tubular guides 86 and 88. The gear wheels 106 and 108 suitably support reels or bobbins 114 and 116 for orbitally supplying the threads 60 to be wrapped around the cords 44 and fastening elements 24 and 26. The ends of the tubular guides 86 and 90 are tapered and slightly spaced apart to guide and accurately place the thread from the bobbin 114. Similarly the tubular guides 88 and 92 are tapered and slightly spaced apart to provide accurate placement of the thread from the bobbin 116. The worm assemblies 82 and 102, the cog wheels 78 and 98, and the gear wheels 104, 106 and 108 are selected to wrap the threads 60 in a predetermined manner, such as around the leg portions 36 of alternate coupling sections. Spring biased guide wheels 122 and 124 are provided to guide the assembled cords and coupling elements from the cord assembling apparatus which may be an integral part of the weaving apparatus or may be a separate apparatus.

The triangular configuration formed by the cross section of the cord 44 and the short legs 36 and 38 of the slide fastener stringers of FIGS. 1–3 with the leg portions 36 and 38 diverging in a V-shape and held apart by the cord 44 between the leg portions 36 and 38 provides a much broader base for attachment to the tapes 20 and 22; thus with the bead threads 52 the meander coupling elements are securely supported. This improved support of the meander coupling element makes possible the manufacture, without a sewing step, of a slide fastener having the strength and stability of the prior art meander coupling elements which were formed with substantially larger leg portions bent to extend parallel over one or both sides at the inner edges of the tapes and sewn to one side of the edges of the tapes. Further, the V-shape configuration results in substantially improved outside bead surfaces for engaging the flanges 140, 142, 144 and 146 of the slider 32; the outward facing surfaces of the beads 29 and 30 are maintained substantially perpendicular to the tapes 20 and 22 by the spaced interconnecting portions 40 and 42. Also the diverging ends of the leg portions 36 and 38 and the interconnecting portions 40 and 42 extend to opposite sides of the tapes resulting in efficient and reliable operation of the coupling elements 24 and 26 by the slider 32.

Figure 9:
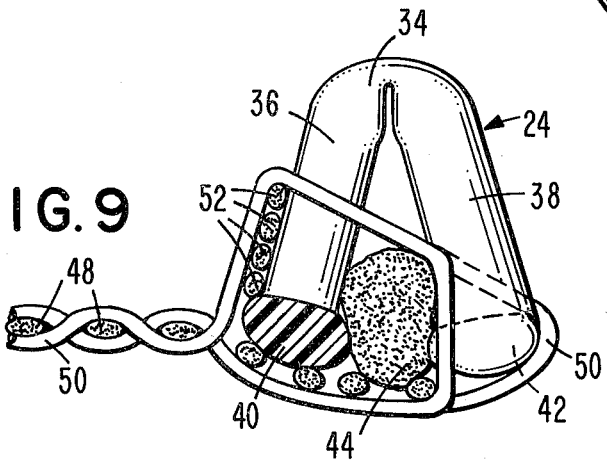
FIG. 9 is a cross-sectional view of one portion of a stringer prior to coupling with an opposite stringer in the slide fastener chain of FIG. 8.
Figure 8:
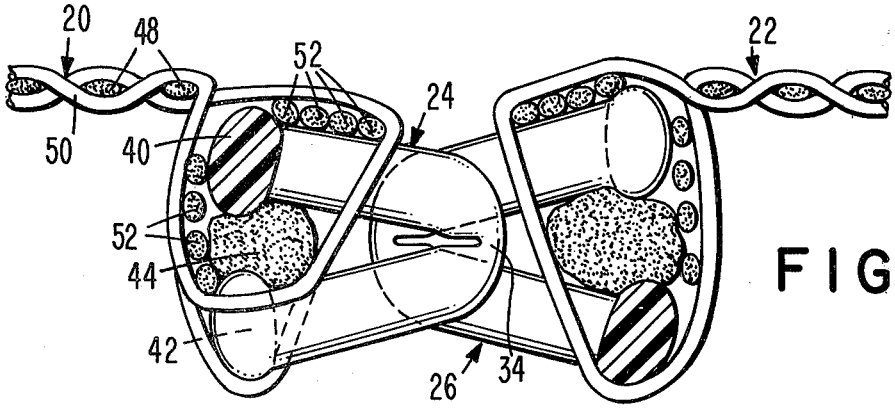
FIG. 8 is a cross-sectional view of a portion of a modified slide fastener chain in accordance with the invention.

A modification of the slide fastener stringer is illustrated in FIG. 8 wherein the tapes 20 and 22 are offset from the coupling elements 24 and 26. As shown in FIG. 9, the left stringer is manufactured by feeding the coupling element 24 with the head portions 34 pointed upward and with the heel portions 40 and 42 and the cord 44 aligned with the warp threads 48. Thus, when the coupling element 24 is bent clockwise as illustrated in FIG. 8, the tape extends from the upper heel portion 40. Also the package threads 52 are not interwoven with the weft thread but rather are disposed along the leg portion 36 and the heel portion 40 to substantially cover the coupling elements 24 and 26 to render them less visible. Also, the tops of the tapes 20 and 22 remain flush and do not have the beads protruding upward therefrom.

Figure 11:
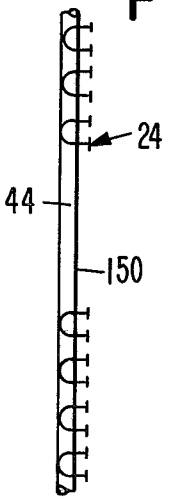
FIG. 11 is a side view of a coupling element with a cord therein during an intermediate step in the manufacture of the slide fastener chain of FIG. 10.
Figure 10:
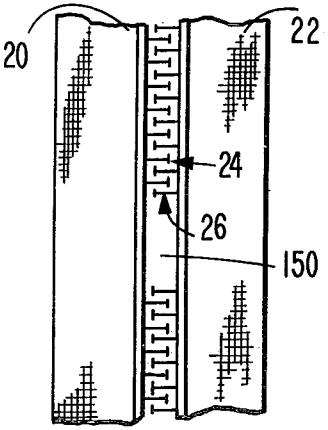
FIG. 10 is a plan view of a continuous slide fastener chain having a gap therein in accordance with the invention.

In manufacturing the chain for the slide fastener a gap 150 can be formed in the slide fastener chain as shown in FIGS. 10 and 11 during the weaving process. The trains of coupling elements 24 and 26 being fed to the stringer assembling station or the weaving machine are intermittently cut prior to their assembly on the cords 44 and the feeding thereof interrupted or discontinued for a short duration as the cords 44 are advanced. After each interruption, the feeding of the elements 24 and 26 is recontinued to produce an assembled cord and fastening element train as shown in FIG. 11 with a gap in the elements. When the cord 44 with the gapped fastening elements is then assembled or woven into a slide fastener chain, the gap 150 is produced. By forming the gap 150 during the weaving process, it is unnecessary to use separate steps of cutting or pulling the elements from the inner edges of the tape. Further the gap 150 is smoother, the ends at the top and bottom of the fastener are covered, and a firmer base is provided for the attachment of separating components like top stops, etc. Less material is used in that no waste is generated by gapping. This method of gapping is also applicable to methods of assembling slide fasteners having other types of continuous coupling elements such as coil elements, continuous molded elements, etc; also other types of assembling could be employed at the assembly station such as sewing, bonding, etc. Automatic equipment can be provided to include a shear for cutting the continuous coupling elements, a detector or an electronic pick counter to determine the length of fastener and the length of gap, and a feed gear that only feeds when the fastener is being formed and discontinues feeding during the formation of the gap.

Figure 12:
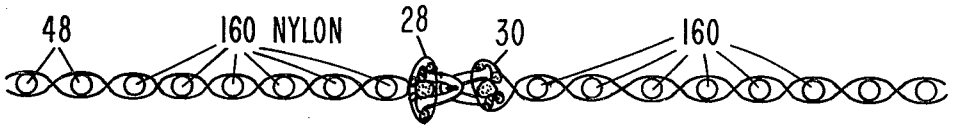
FIG. 12 is a cross-sectional view of still a further modification of the slide fastener in accordance with the invention.

A further modification of the slide fastener is illustrated in FIG. 12 wherein a number of warp threads, such as six warp threads 160, adjacent the beads 28 and 30 are nylon in order to make the operation of the slider easier.

Since the present invention is subject to many modifications, variations and changes in detail, it is intended that all matter in the foregoing description and shown in the accompanying drawing being interpreted as illustrative and not in a limiting sense.

What is claimed is:

1. A stringer for a slide fastener comprising an elongated coupling element formed from a meandering continuous filament and having successive sections each including a head portion formed by flattening the filament, a pair of leg portions extending from opposite sides of the head portion in diverging directions to form a V-shaped configuration, and interconnecting portions joining the pair of leg portions to the respective opposite adjoining sections, said interconnecting portions alternately extending in a pair of diverging planes which intersect at the head portions and extend along the leg portions from the respective opposite sides of the head portions;

a cord extending between the leg portions of each pair of leg portions and between the alternating interconnecting portions to maintain the pairs of leg portions apart in the V-shaped configuration;

a woven tape having warp threads parallel to the coupling element and having an interwoven weft thread which passes around the cord and the alternating interconnecting portions to secure the coupling element to the tape;

said interconnecting portions being flattened substantially perpendicular to the respective planes along which they extend, said flattened interconnecting portions engaging the cord to maintain the cord between the leg portions of each pair of leg portions.

2. A woven stringer for a slide fastener comprising an elongated coupling element formed from a meandering continuous filament and having successive sections each including a head portion formed by flattening the filament, a pair of leg portions extending from opposite sides of the head portion in diverging directions to form a V-shaped configuration, and interconnecting portions joining the pair of leg portions to the respective opposite adjoining sections, said interconnecting portions alternately extending in a pair of diverging planes which intersect at the head portions and extend along the leg portions from the respective opposite sides of the head portions;

a cord extending between the leg portions of each pair of leg portions and between the alternating interconnecting portions to maintain the pairs of leg portions apart in the V-shaped configuration;

said cord forming with each of said pair of leg portions a triangular cross-sectional configuration; and a woven tape having warp threads parallel to the coupling element and having an interwoven weft thread which passes around the cord and the alternating interconnecing portions to secure the coupling element to the tape.

3. A stringer as claimed in claim 1 including a wrapping thread wrapped around the cord and the meandering filament to secure the cord to the coupling element between the leg portions of each pair of leg portions.

4. A stringer as claimed in claim 3 wherein the wrapping thread is wrapped around one leg portion of alternate pairs of leg portions and the cord.

5. A stringer as claimed in claim 1 including a plurality of package threads overlying the interconnecting portions and secured by the weft thread.

6. A stringer as claimed in claim 5 wherein the package threads are interwoven with the weft thread.

7. A stringer as claimed in claim 5 wherein the package threads are all circumscribed together with the interconnecting portions and the cord by the weft thread.

8. A stringer as claimed in claim 1 wherein the tape is offset relative to the cord between the leg portions.

9. A stringer as claimed in claim 1 wherein the tape extends transverse to a plane defined by the head portions and the cord.

10. A stringer as claimed in claim 1 wherein a plurality of the warp threads in the tape adjacent the coupling element are nylon.

11. A method of forming a stringer for a slide fastener comprising forming a continuous filament into a meander coupling element having successive sections each including a flattened head portion, a pair of leg portions extending from opposite sides of the head portion in diverging directions to form a V-shaped configuration, and interconnecting portions joining the pair of leg portions to the respective opposite adjoining sections, said interconnecting portions alternately extending in a pair of diverging planes which intersect at the head portions and extend along the leg portions from the respective opposite sides of the head portion;

inserting a cord between and substantially aligned with the alternating interconnecting portions and between the leg portions of the coupling element to extend longitudinally throughout the length of the coupling element so as to form a triangular cross-sectional configuration of each pair of leg portions and the cord; and weaving a weft thread with a plurality of warp threads and around the coupling element and inserted cord to form a slide fastener tape with attached coupling elements.

12. A method as claimed in claim 11 including wrapping a thread around the filament forming the coupling element and inserted cord to secure the cord in the coupling element prior to the weaving step.

13. A method as claimed in claim 12 wherein the thread wrapped around the filament and cord is wrapped around leg portions on one side of the head portions and the inserted cord.

14. A method of manufacturing a pair of stringers for a gapped woven slide fastener chain comprising the steps of simultaneously feeding a pair of carrier means and a pair of continuous coupling elements to an assembling station, assembling the pair of carrier means and the respective continuous coupling elements to form a pair of stringers of a slide fastener chain at the assembling station, cutting the pair of continuous coupling elements, discontinuing the feeding of the pair of continuous coupling elements while continuing the feeding of the pair of carrier means through the assembling station, and recontinuing the simultaneous feeding of the pair of continuous coupling elements to the assembly station to form a gap in the coupling elements on the carrier means of each stringer.

15. A method as claimed in claim 14 wherein the pair of carrier means each include a plurality of warp threads and a weft thread, the assembling station is a weaving station, the assembling step includes weaving the weft thread with the respective pluralities of warp threads and the respective continuous coupling element.

16. A method as claimed in claim 15, wherein the coupling elements are formed from a meandering continuous filament and have successive sections each including a flattened head portion, a pair of leg portions extending from opposite sides of the head portion in diverging directions to form a V-shaped configuration, and interconnecting portions joining the respective pair of leg portions to the opposite adjoining sections, said interconnecting portions alternately extending in a pair of diverging planes which intersect at the head portions and extend along the leg portions from the respective opposite sides of the head portions; and including the step of inserting a pair of cords between the alternating interconnecting portions and between the leg portions of the respective coupling elements to extend longitudinally throughout the lengths of the coupling elements prior to the weaving step.

17. A method as claimed in claim 16 including wrapping a pair of threads around the respective filaments formed into the coupling elements and inserted cords to secure the cords in the coupling elements prior to the weaving step.

18. A method as claimed in claim 17 wherein the pair of threads wrapped around the filaments and the cords are wrapped around one leg portion on one side of the head portions and the inserted cords.

* * * * *